US006524147B1

(12) United States Patent
Hundertmark

(10) Patent No.: US 6,524,147 B1
(45) Date of Patent: Feb. 25, 2003

(54) POWER ASSIST MARINE STEERING SYSTEM

(75) Inventor: James M. Hundertmark, Fond du Lac, WI (US)

(73) Assignee: Mark X Steering Systems, LLC, Oshkosh, WI (US)

( * ) Notice: Subject to any disclaimer, the term of this patent is extended or adjusted under 35 U.S.C. 154(b) by 0 days.

(21) Appl. No.: 09/967,792

(22) Filed: Sep. 28, 2001

(51) Int. Cl.[7] ..... B63H 20/12
(52) U.S. Cl. ..... 440/61; 114/150
(58) Field of Search ..... 114/150; 440/61

(56) References Cited

U.S. PATENT DOCUMENTS

| | | | |
|---|---|---|---|
| 2,855,755 | A | * 10/1958 | Auger |
| 3,475,911 | A | * 11/1969 | Harrison |
| 4,892,494 | A | 1/1990 | Ferguson |
| 4,976,639 | A | 12/1990 | Rawlings et al. |
| 5,002,510 | A | 3/1991 | Rump |
| 5,031,562 | A | 7/1991 | Nakase et al. |
| 5,057,043 | A | 10/1991 | Sugimoto et al. |
| 5,074,193 | A | 12/1991 | Hundertmark |
| 5,092,801 | A | 3/1992 | McBeth |
| 5,104,294 | A | 4/1992 | Banba |
| 5,127,856 | A | 7/1992 | Kabuto et al. |
| 5,146,745 | A | 9/1992 | Doetsch |
| 5,188,051 | A | 2/1993 | Huber |
| 5,213,527 | A | 5/1993 | Fetchko |
| 5,240,445 | A | 8/1993 | Aoki et al. |
| 5,241,894 | A | 9/1993 | Hundertmark |
| 5,244,426 | A | 9/1993 | Miyashita et al. |
| 5,349,818 | A | 9/1994 | McFadyen et al. |
| 5,350,326 | A | 9/1994 | Funami et al. |
| 5,376,029 | A | 12/1994 | Entringer et al. |
| 5,387,142 | A | 2/1995 | Takayanagi et al. |
| 5,409,410 | A | 4/1995 | Bohlin |
| 5,427,045 | A | 6/1995 | Fetchko |
| 5,427,556 | A | 6/1995 | Ishikawa et al. |
| 5,447,456 | A | 9/1995 | Nakayasu |
| 5,466,178 | A | 11/1995 | Inman, Sr. et al. |
| 5,481,871 | A | 1/1996 | McFadyen |
| 5,503,098 | A | 4/1996 | Bohlin |
| 5,509,369 | A | 4/1996 | Ford et al. |
| 5,603,279 | A | 2/1997 | Hundertmark et al. |
| 5,605,109 | A | 2/1997 | Merten et al. |
| 5,632,217 | A | 5/1997 | Ford et al. |
| 5,638,679 | A | 6/1997 | Richards |
| 5,702,275 | A | 12/1997 | Hundertmark |
| 5,924,379 | A | 7/1999 | Masini et al. |
| RE36,342 | E | 10/1999 | McFadyen et al. |
| 5,997,370 | A | 12/1999 | Fetchko et al. |
| 6,113,444 | A | 9/2000 | Ritger |
| 6,138,596 | A | 10/2000 | Gonring et al. |
| 6,148,853 | A | 11/2000 | Wang |
| 6,164,320 | A | 12/2000 | Hamano et al. |
| 6,199,498 | B1 | 3/2001 | Hundertmark et al. |

* cited by examiner

*Primary Examiner*—Sherman Basinger
(74) *Attorney, Agent, or Firm*—Boyle Frederickson Newholm Stein & Gratz S.C.

(57) ABSTRACT

A power steering system for a watercraft comprises a hydraulically actuated, unbalanced steering cylinder assembly, a pressure source, and helm that is spaced from the steering cylinder assembly. The helm includes a helm cylinder having a slave chamber fluidically coupled to a second chamber in the steering cylinder, a high pressure port fluidically coupled to the outlet of the pressure source and to a first chamber in the steering cylinder, and a return port fluidically coupled to vent. A control valve assembly is movable between at least first and second positions to alternatively couple a control chamber in the helm cylinder to the high pressure and return ports. In order to facilitate mounting of the helm to the dash of the watercraft, the helm has only three ports, and all three ports are all located on a rear axial end of the helm cylinder.

19 Claims, 6 Drawing Sheets

POWER ASSIST MARINE STEERING SYSTEM

BACKGROUND OF THE INVENTION

1. Field of the Invention

The invention relates to marine steering systems and, more particularly, relates to a power assist steering system for a boat or other watercraft. Specifically, the invention relates to a steering system that incorporates an operator controlled helm and a separate hydraulic steering cylinder that is controlled by the helm in a master/slave fashion to steer the watercraft.

2. Discussion of the Related Art

In a conventional marine steering system, a watercraft such as a boat is steered by pivoting a rudder and/or outboard motor on the stern of the watercraft about a vertical steering axis upon steering actuation by an operator stationed at the helm. One typical steering system for a boat having a hull-mounted motor comprises a steering cable extending between the steering helm and the motor so that steering at the helm actuates the cable to pivot the motor about the steering axis. The cable typically comprises a push-pull cable having a reciprocatable inner core slidable in a protective, flexible outer sheath or housing. One end of the cable is connected to the steering helm, and the other end is connected to a tiller arm coupled to the motor or rudder. When the wheel is turned at the helm, the cable is actuated by a push-pull movement of the inner core, thereby pivoting the tiller arm. These systems work reasonably well on small boats, but the steering forces required for pivoting the tiller arm increase progressively with system size to the point that many larger boats can be steered manually only with great difficulty, if at all.

In order to reduce the forces required to steer a watercraft, it is well-known with marine outboard drives, particularly those employing large displacements, to employ a hydraulic power steering assist system for assisting the operator in steering the boat. The typical hydraulic power steering assist system includes a hydraulic cylinder that is connected to a tiller arm or other steered mechanism and that is energized in response to operator control to actuate the steered mechanism. Specifically, a helm-responsive controller is coupled to a hydraulic cylinder assembly that, in turn, is coupled to the steered mechanism, either directly or via an intervening push-pull cable. When the steering wheel is turned one way or the other, hydraulic fluid is pumped from the steering helm to one end or the other of the cylinder assembly to pivot the motor one way or the other.

A power steering assist system that is generally of the type described above is described in U.S. Pat. No. 5,603,279 (the '279 patent). The system described in the '279 patent comprises a hydraulic cylinder-piston assembly and a helm. The cylinder-piston assembly has a reciprocally mounted piston and first and second chambers in the cylinder on opposite sides of the piston. The steering cylinder has a balanced piston. In fact, as with most systems of this general type, a rod extends through both ends of the steering cylinder making for a longer assay. The helm includes two separate cylinder assemblies that are divided into four separate internal chambers by a stepped flanged piston. One of the cylinder assemblies forms a master cylinder that is actuated directly by a control valve assembly under power supplied from the pressure source. The portion of the piston in this part of the assembly is stepped so as to form an unbalanced cylinder in the helm. The second cylinder assembly comprises a slave cylinder divided into third and fourth chambers by an annular flange on an extension of the piston. The third and fourth chambers are coupled to respective chambers of a steering cylinder. The control valve assembly is actuatable to regulate the flow of hydraulic fluid into and out of the second chamber to drive the piston and, thereby, vary the volumes of the third and fourth chambers and driving the steering piston one way or the other within the steering cylinder to effect a steering operation. The actuator of the valve assembly comprises a rotatable valve body that has first and second valves mounted in it. A rotatable input member (e.g., a steering shaft or extension thereof), actuable upon steering at the helm, is operably connected to the valve actuator. Thus, steering at the helm actuates the valve actuator to regulate the flow of pressurized hydraulic fluid through the cylinder, thereby driving the piston in one direction or the other depending upon the steering direction.

The system disclosed in the '279 patent, while effective, exhibits several drawbacks and disadvantages. For instance, because its helm has four chambers and, in effect, two pistons, it requires a great many seals. The helm is also relatively large (both axially and radially). In fact, it is so large that it must be formed from a casting rather than machined components. It is therefore difficult to mount on the back of the dashes of many smaller boats. Several of the hydraulic fittings on the helm also are necessarily located on the periphery of the helm rather than on the rear end, rendering it difficult to access those fittings after the helm is installed behind the dash.

In addition, the rotary valve employed by the '279 patent is relatively expensive to manufacture and difficult to assemble.

Moreover, in the system disclosed in the '279 patent, only part of the system (namely, the first and second chambers of the helm) is pressurized directly by the pressure source. The remainder of the system (namely, the third and fourth chambers of the helm and both chambers of the steering cylinder) is pressurized indirectly via translation of the slave portion of the piston. Air in the lines of that portion of the system can lead to noticeable "looseness" or play of the cylinders.

The need therefore has arisen to provide a power assist marine steering system that is relatively simple in construction and easy to assemble.

The need further exists to provide a power assist marine steering system including a helm that is relatively compact so as to be easily mountable to the dash and accessible from behind the dash of a boat.

SUMMARY OF THE INVENTION

In accordance with a first aspect of the invention, a power steering assist system for a watercraft comprises a hydraulically actuated, unbalanced steering cylinder assembly, a pressure source, and helm that is spaced from the steering cylinder assembly. The steering cylinder assembly is configured for connection to a steered mechanism of the watercraft. It includes a steering cylinder, a steering piston that is mounted in the steering cylinder to define first and second chambers on opposite sides thereof, and a rod that is affixed to the steering piston, wherein either the rod or the steering cylinder is movable relative to the other and is configured for connection to the steered mechanism. Fluid pressures in the first and second chambers act on first and second different effective areas of the steering piston. The helm includes a helm cylinder having a slave chamber fluidically coupled to the second chamber in the steering cylinder, a high pressure port fluidically coupled to the outlet of the pressure source and to the first chamber in the steering cylinder, and a return port fluidically coupled to a vent. The helm additionally includes a helm piston that is slidably mounted in the helm cylinder so as to form the slave chamber and a control chamber on opposite sides thereof, and a control valve assembly that is movable between at least first and second positions to alternatively couple the control chamber to the high pressure and return ports.

Preferably, the control valve assembly is movable into a third, neutral position in which the control chamber is isolated from both the high pressure and return ports. In this case, the helm further comprises an operator-manipulatable steering mechanism. The control valve assembly comprises first and second two-way/two-position valves that are configured to be actuated by the steering mechanism such that 1) both the first and second valves remain closed when the steering mechanism remains stationary, 2) movement of the steering mechanism in a first direction opens the first valve while leaving the second valve closed, and 3) movement of the steering mechanism in a second direction opens the second valve while leaving the first valve closed. The control valve assembly comprises a valve body that houses the first and second valves and a valve actuator that is linearly translatable between first, second, and third positions thereof, the valve body having a first passage formed therein that couples the high pressure port to the control chamber and a second passage formed therein that couples the return port to the control chamber, and wherein the first and second valves are located in the first and second passages, respectively. The resultant system is simple and compact. It is also pressurized directly by a single source. It therefore does not exhibit the looseness experienced by some other systems.

In order to facilitate mounting of the helm to the dash of the watercraft, the helm has only three ports (namely, a slave port that is fluidically connected to the second chamber in the steering cylinder, the high pressure port, and the return port), and all three ports are all located on a rear axial end of the helm cylinder. The helm cylinder also is very compact.

In accordance with other aspects of the invention, an improved helm cylinder and an improved power assist steering method are also provided.

These and other advantages and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
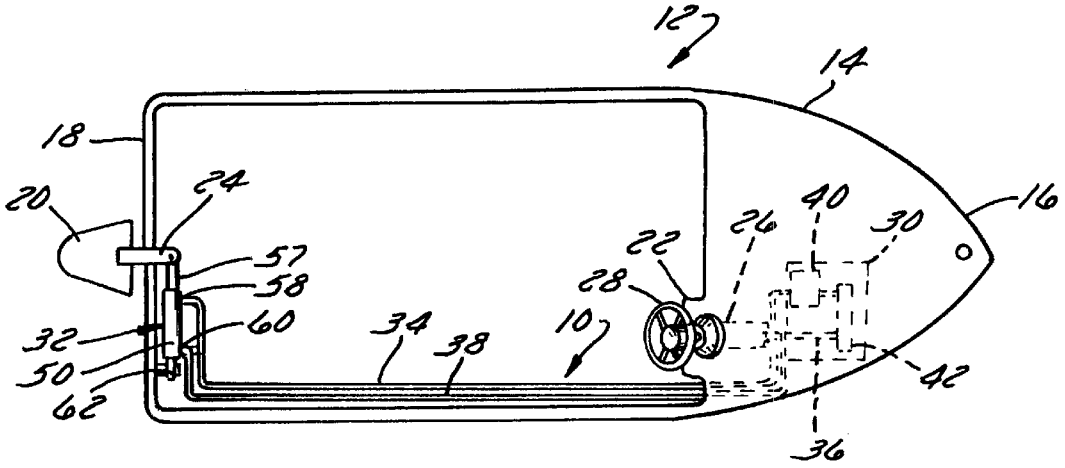
FIG. 1 is a schematic top plan view of a boat incorporating a power steering assist system constructed in accordance with a preferred embodiment of the present invention.

Turning now to the drawings and initially to FIG. 1, a boat 12 incorporates a power steering assist system 10 (hereafter simply "power steering system") constructed in accordance with a preferred embodiment of the present invention. The boat 12 includes a hull 14 having a bow 16 and a stern 18, an outboard motor 20 mounted on the stem 18, and a cowling or dash 22 extending laterally across the hull 14 near the bow 16. As is conventional, the motor 20 is mounted on the boat 12 by a pivoting mount assembly (not shown) that permits the motor 20 to be pivoted about a vertical axis to cause a rudder formed on or by the motor 20 to steer the boat 12. The motor 20 could alternatively be a non-pivoting inboard or outboard motor, and boat 12 could be steered by one or more rudders movable separately from the motor 20.

Figure 2:
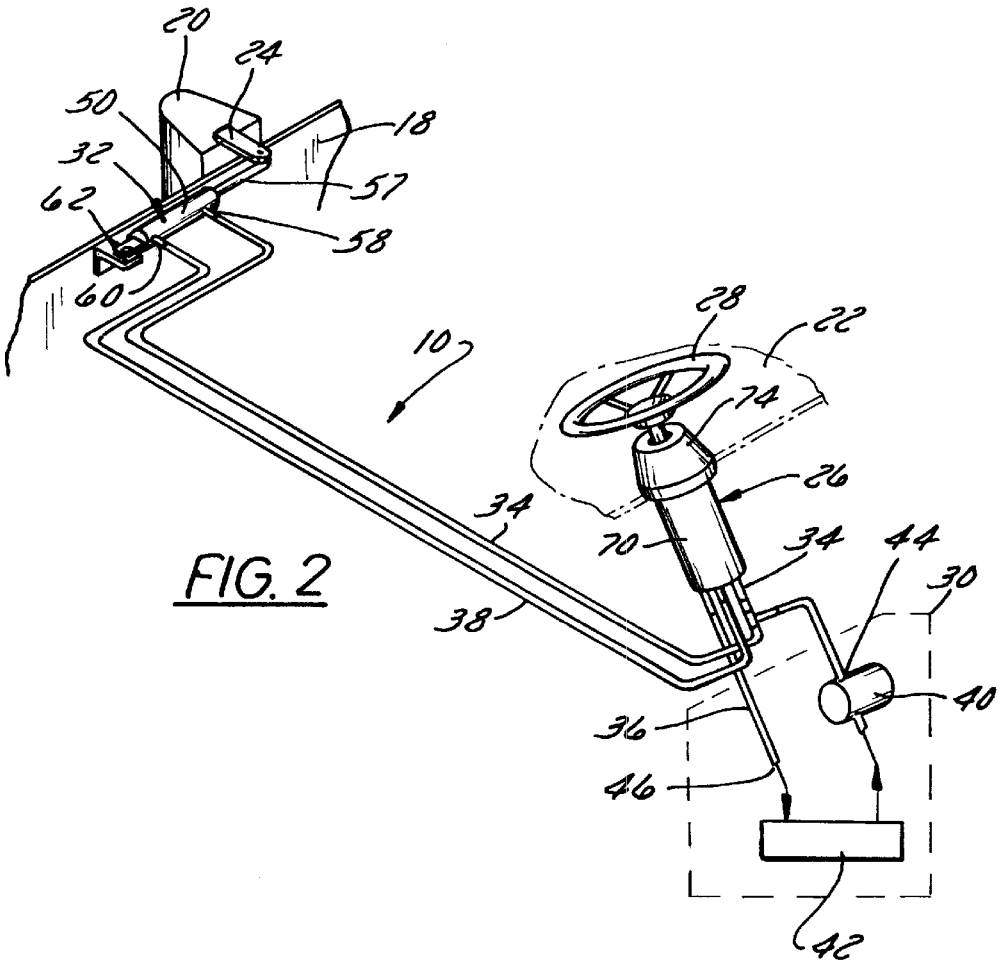
FIG. 2 is a somewhat schematic perspective view of the power steering assist system of FIG. 1.

Referring now to FIGS. 1–2, the steering system 10 for the boat 12 includes a tiller arm 24 coupled to the motor 20 and forming the boat's steered mechanism, a helm 26 including a steering wheel 28 serving as the boat's steering mechanism, a pressure source 30, and a steering cylinder assembly 32. The present embodiment contains no mechanical linkage connecting the helm 26 to the steering cylinder assembly 32. Both assemblies 26 and 32 are pressurized by a single power source. The helm 26 is mounted through the dash 22 and is actuated by the steering wheel 28. The steering cylinder assembly 32 is actuated by the helm 26 to move the tiller arm 24 and pivot the motor 20 on its mount under power supplied by the pressure source 30. In order to minimize the size and weight of the components that are mounted behind the dash 22, the steering cylinder assembly 32 is located remote from the helm 26, possibly adjacent the motor 20 as illustrated or on the motor, so as to be connectable directly to the tiller arm 24. Alternatively, the steering cylinder assembly 32 could be mounted at some other location on the boat 12 and connected to the tiller arm 24 by a push-pull cable or the like. The helm 26 is connected to the pressure source 30 by a high pressure line 34 and a return line 36. It is also connected to the steering cylinder assembly 32 by the high pressure line 34 and a slave line 38.

The fluid pressure source 30 could comprise any structure or assembly capable of generating hydraulic pressure and of transmitting it to the helm 26 and the steering cylinder assembly 32. It also can be located virtually anywhere on the boat 12. In the illustrated embodiment, the fluid pressure source 30 includes a pump 40 and a reservoir 42, best seen in the assembly illustrated in FIG. 2. The pump 40 has an inlet connected to an outlet of the reservoir 42 and has an outlet 44 connected to or, as in the illustrated embodiment, forming the pressurized outlet of the pump assembly 30. An accumulator (not shown) could be provided between the pump outlet 44 and the helm 26, if desired. The reservoir 42 has an inlet 46 connected to or, as in the illustrated embodiment, forming the unpressurized inlet of the pressure source 30.

Referring to FIGS. 2, 4, 5, and 6 the steering cylinder assembly 32 comprises a hydraulically actuated, unbalanced steering cylinder assembly operatively coupled to the helm 26, the pump outlet 44, and the tiller arm 24. "Unbalanced" as used herein means that the cylinder assembly's piston has different effective surface areas on opposite sides thereof such that equal fluid pressures on both sides of the piston generate an intensification effect on the side of the piston having a greater effective surface area and drive the piston to move towards the side of the cylinder facing the side of the piston having a smaller effective surface area. The steering cylinder assembly 32 includes a steering cylinder 50, a steering piston 52 mounted in the steering cylinder to form first and second chambers 54, 56 on opposite sides of the steering piston 52, and a rod 57 connected to the steering piston 52. First and second ports 58, 60 open into the first and second chambers 54 and 56 for connection to the high pressure line 34 and the slave line 38, respectively. The steering cylinder 50 of this embodiment is stationary and is mounted on the stem 18 of the hull 14 by a suitable bracket 62. The rod 57 extends axially through a rod end 64 of the steering cylinder 50 (disposed opposite a cylinder end 66) and terminates at a free end that is coupled to the tiller arm 24. The unbalanced condition of the assembly 32 therefore is created by virtue of the attachment of the rod 57 to the steering piston 52 and the consequent reduction in piston surface area exposed to fluid pressure in the first chamber 54. Alternatively, the rod 57 could extend completely through the steering cylinder 50 and could be affixed to a stationary support, in which case the steering cylinder 50 would be coupled to the tiller arm 24 and would reciprocate relative to the stationary piston 52. In this case, the unbalanced condition of the assembly 32 would be achieved by other measures, e.g., by making one end of the steering rod 57 diametrically smaller than the other.

Figure 3:
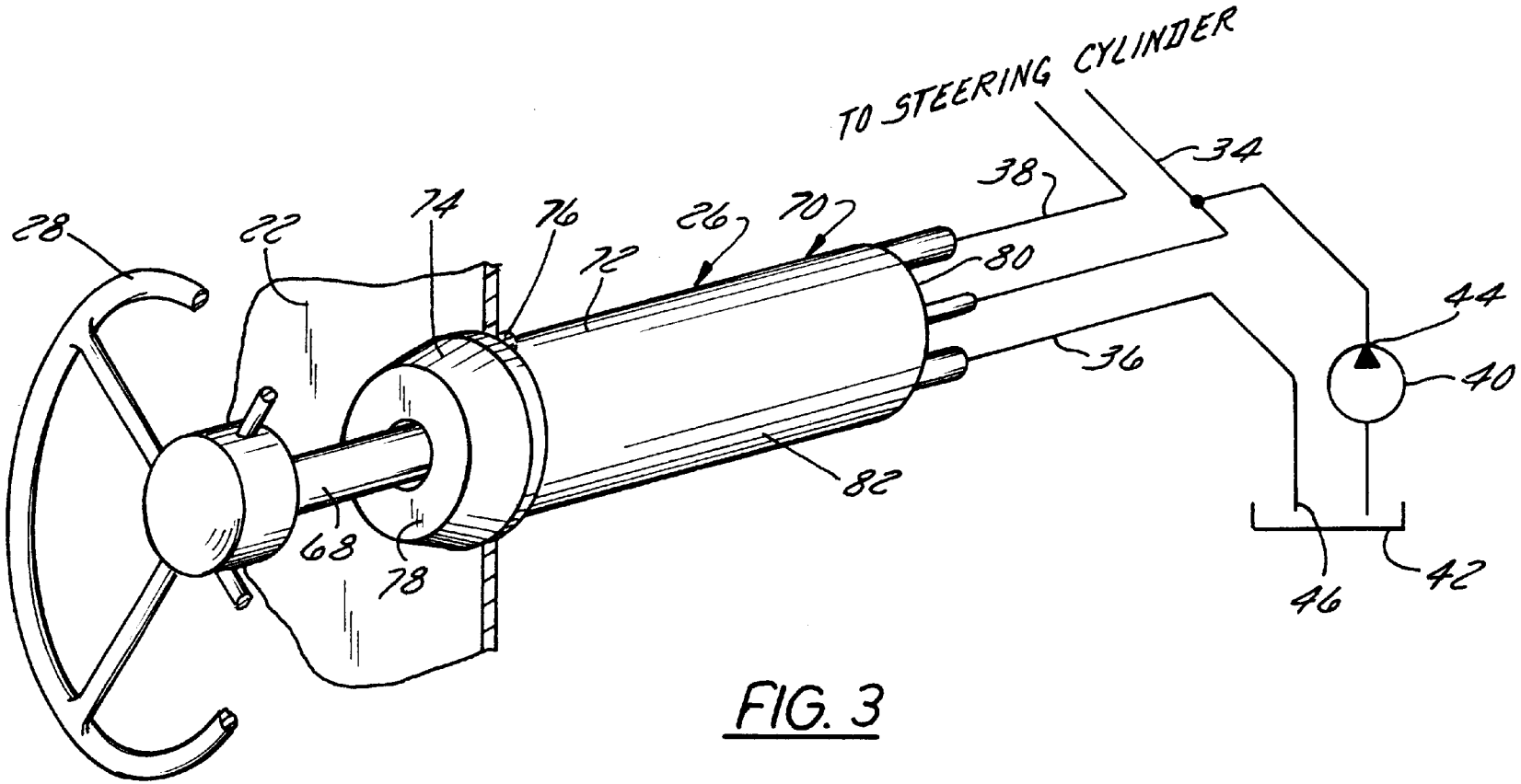
FIG. 3 is an elevation view of a portion of a dash of the boat of FIG. 1, showing a steering wheel and a helm of the power steering assist system mounted on the dash.

Referring to FIG. 3, the helm 26 is mounted through the dash 22. It includes the steering wheel 28, a steering shaft 68 extending forwardly from the dash 22, and a helm cylinder 70 located behind the dash 22. The helm cylinder 70 is relatively compact, having a body 72 and a cap 74 screwed onto the front end of the body 72. The back end of the cap 74 is mounted on the front surface of the dash 22 by bolts 76. The body 72 is cylindrical, having a front axial end 78, a rear axial end 80, and an outer radial periphery 82. It is very narrow, having a diameter of no more than 4 inches and preferably no more than about 3 inches. The body 72 also is relatively short, having a total length of no more than about 6" to 7". The entire helm cylinder 70, including the body 72 and the cap 74, is no longer than 11" to 12". Mounting behind the dash 22 is facilitated by the fact that the helm cylinder 70 has only a limited number of fittings (three in the preferred embodiment), and all of those fittings extend from the relatively easily-accessible rear axial end 80 of the helm cylinder 70. The helm 26 therefore is considerably smaller than the helm disclosed in the '279 patent and easier to mount to the dash. It is also considerably lighter, weighing 6 to 7 pounds less than the commercial version of the helm disclosed in the '279 patent. The helm cylinder also need not be formed from a casting.

The hydraulic circuitry contained within the pressure source 30, the helm 26, and the steering cylinder assembly 32 will now be described with reference to FIG. 4. The helm cylinder 70 has a high pressure inlet port 84 connected to the high pressure line 34, a slave port 86 connected to the slave line 38, and a return port 88 connected to the return line 36. Located within the helm cylinder 70 are a control valve assembly 90, a helm piston 92, a relief valve 94, and check valve 96 and 201. The helm piston 92 is slidably disposed in the helm cylinder 70 to form a slave chamber 98 and a control chamber 100 on opposite sides thereof. The slave chamber 98 is in constant fluid communication with the second chamber 56 in the steering cylinder 50 via the slave line 38. The control chamber 100 is in constant fluid communication with the control valve assembly 90 which, in turn, is coupled to the pressure source outlet 44 and inlet 46 by the high pressure line 34 and the return line 36, respectively. Check valve 200 is located in high pressure line 34 and prevents backflow into the pump 40.

The control valve assembly 90 includes first and second normally, closed two-way/two-position valves. Still referring to FIG. 4, the first valve is a supply valve 102 having an inlet port 104 coupled to the high pressure inlet port 84 and having an output port 106 coupled to the control chamber 100. The second valve is a vent valve 108 having an inlet port 110 coupled to the control chamber 100 and an outlet port 112 connected to the return port 88 via the valves 94 and 96. Both valves 102 and 108 are coupled to a common actuator (preferably the steering shaft 68), such that movement of the actuator in a first direction opens one of the valves 102 or 108 while leaving the other valve closed, and movement of the actuator in a second direction opens the other valve 108 or 102 while leaving the one valve closed.

It can thus be seen that the first chamber 54 of the steering cylinder 50 will always be at a pressure P1 that is the same pressure as the pump outlet pressure. The slave chamber 98, control chamber 100 of the helm cylinder 70 and the second chamber 56 of the steering cylinder 50 will all be at a second pressure P2 when no load is applied to the rod 57. The pressure P2 will, depending upon the operational state of the valve assembly and the direction of load applied to rod 57, vary from a low of essentially 0 psi relative to the atmosphere to a high of P1 (typically on the order of 1000 psi). Due to this arrangement, pressurized fluid flow into the control chamber 100 from the supply valve 102 drives the helm piston 92 to the left as seen in FIG. 4 to create a pressure differential across the steering piston 52 (generated by the unbalanced nature of the steering piston) and drive the steering piston 52 and rod 57 to the right as seen in FIG. 4. Conversely, venting of the control chamber 100 upon opening of the vent valve 108 causes the helm piston 92 to move to the right as seen in FIG. 4, leading to the fluid flow into the slave chamber 98 from the second chamber 56 of the steering cylinder 50 and creating a reverse pressure differential that drives the steering piston 52 to the left as seen in FIG. 4.

Figure 4:
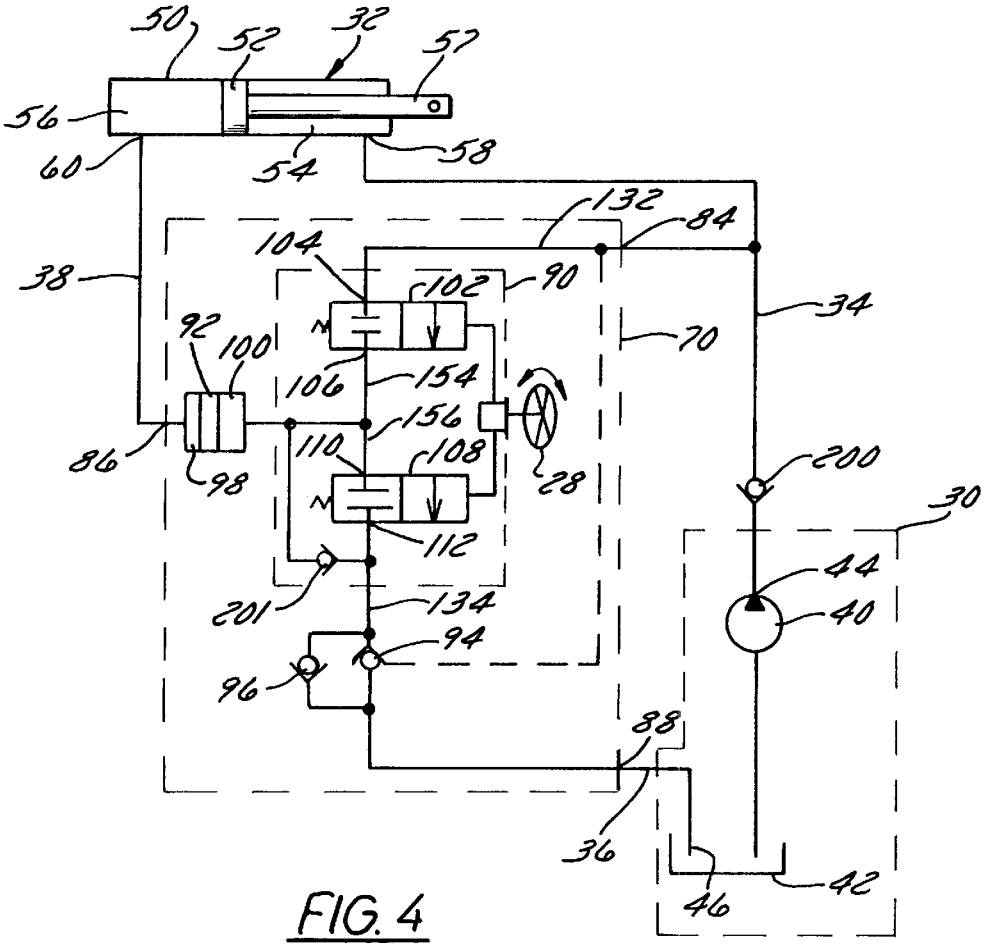
FIG. 4 is a hydraulic circuit schematic of the power steering assist system.

The relief valve 94 is locatable either internally of the helm cylinder 70 as illustrated in FIG. 4 or externally of the helm cylinder. Valve 94 is operable to normally permit unrestricted flow from the control chamber 100 upon opening of the vent valve 108 and to restrict the flow of fluid from the control chamber to a preset pressure if the pump 40 is not operational and, accordingly, the inlet port 84 is not pressurized. The relief valve 94 is normally held open by pilot pressure from the high pressure line 34 or another constantly pressurized portion of the system. The relief valve 94 closes in the absence of that pilot pressure to prevent fluid flow to the return port 88 unless the fluid pressure upstream of the relief valve 94 is above a check pressure (typically 300 psi).

Figure 5:
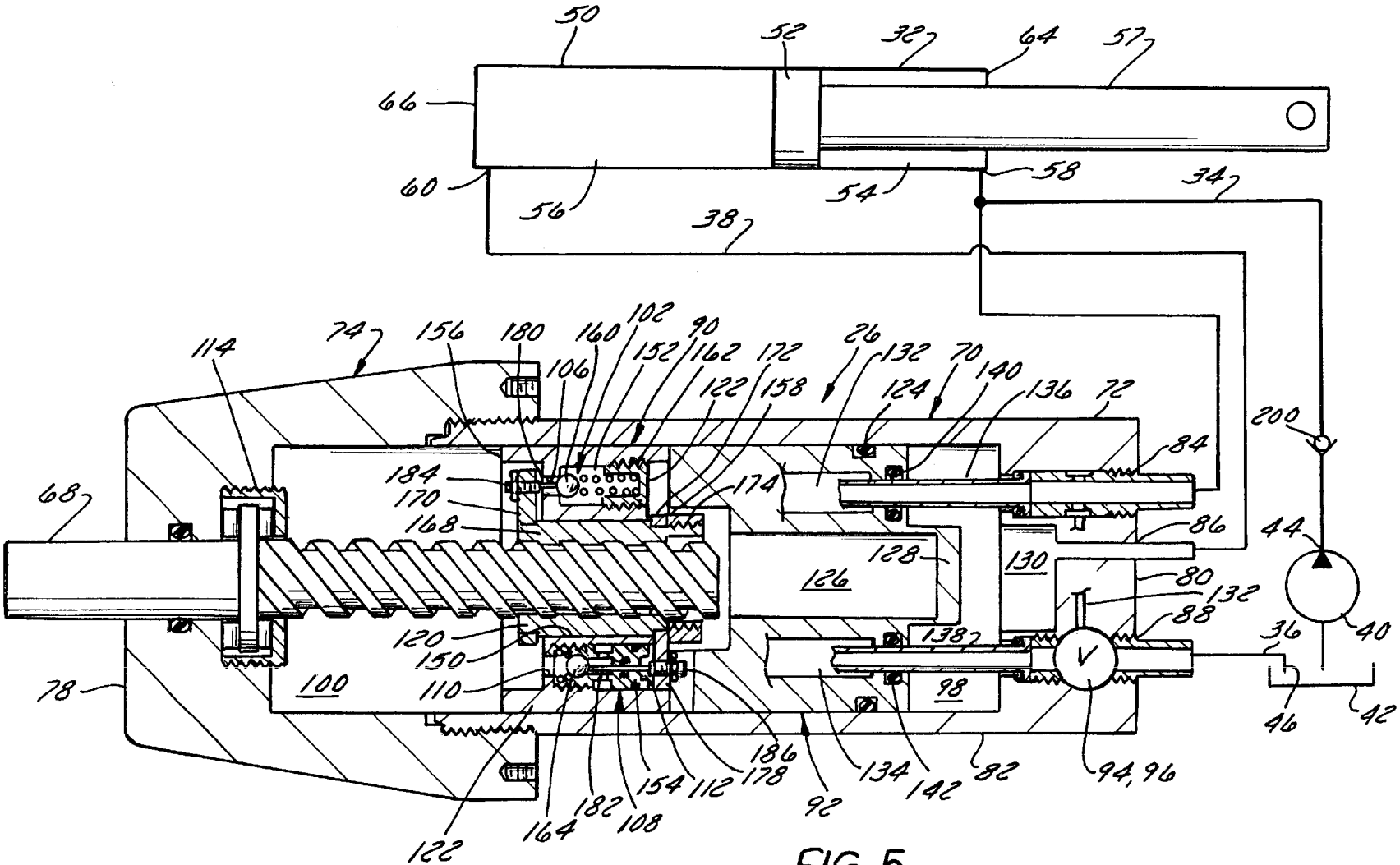
FIG. 5 is a side sectional elevation view of the power steering assist system, illustrating the system in a first operational state thereof.

Turning now to FIG. 5, the physical structure of the helm assembly incorporating the hydraulics of FIG. 4 can be seen to include the steering shaft 68, the control valve assembly 90, the helm piston 92, the relief valve 94, and the check valve 96. The steering shaft 68 is rotatably borne in the helm cylinder 70 by thrust bearings 114 that permits rotation of the steering shaft 68 relative to the helm cylinder 70 but that prevents relative axial movement therebetween. The inner end the steering shaft 68 is threaded for cooperation with a valve actuator 120 of the control valve assembly 90. A number of threaded shafts could be used for this purpose. A particularly preferred shaft is a so-called "acme screw" having a high pitch that effects a relatively large stroke of the actuator with relatively small rotation of the shaft. The control valve assembly 90 includes the valve actuator 120 and a valve body 122 coaxially surrounding the valve actuator 120. The valve body 122 and helm piston 92 are coaxially located within the helm cylinder 70 and bolted to one another in an end-to-end relationship so as to move as a unit within the helm cylinder 70. The valve body 122 also houses the supply and vent valves 102 and 108 and cooperates with the valve actuator 120 to selectively open and close the valves 102 and 108 upon steering shaft rotation.

Figure 7:
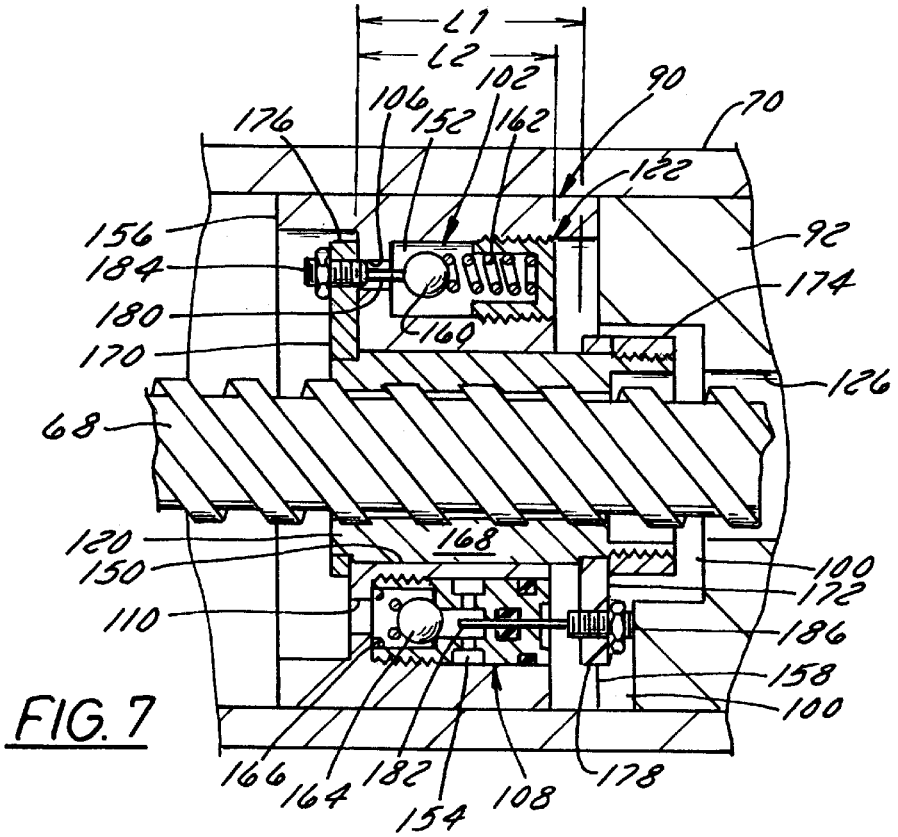
FIG. 7 corresponds to FIG. 6 and illustrates the system in a second operational state thereof.

Still referring to FIG. 5, the helm piston 92 is mounted in the helm cylinder 70 so as to form the control and slave chambers 100 and 98 on opposite sides of it. The two chambers 98 and 100 are sealed from one another by a single 0-ring 124 mounted in a groove in the outer periphery of the helm piston 92. The helm piston 92 also has a deep counterbore 126 formed in its front end to accommodate movement of the helm piston 92 over the steering shaft 68 as seen in FIG. 7. The counterbore 126 terminates in an extension 128 on the rear end of the helm piston 92. The extension 128 bottoms out in a counterbore 130 in the rear end 70 of the helm cylinder 70 when the helm piston 92 assumes its right-most position within the helm cylinder. The slave port 86 opens into the counterbore 130. Supply and return bores 132 and 134 are formed axially through the helm piston 92 on opposite sides of the counterbore 130. Supply and return tubes 136 and 138 extend partway into the bores 132 and 134 from the high pressure and return ports 84 and 88, respectively. The tubes 136 and 138 are sealed against the respective bores 132 and 134 by respective seals 140, 142 to permit fluid to flow into and out of the helm piston 92 from the rear end 80 of the helm cylinder 70 while permitting relative axial movement between the helm piston 92 and the tubes 136 and 138.

Figure 6:
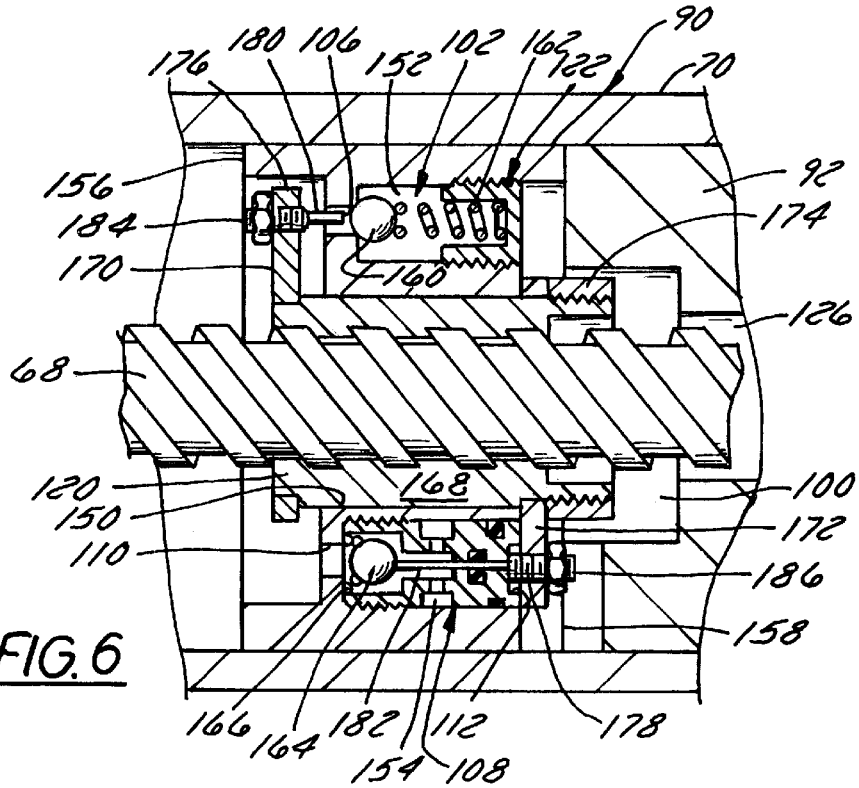
FIG. 6 is a detail sectional elevation view, illustrating a valve assembly of the helm of the power assist steering system in a first operational state thereof.

Referring to FIGS. 5 and 6, the valve body 122 includes a tubular element disposed in the control chamber 100 in a non-fluid tight manner so that the control chamber 100 surrounds both ends of the valve body 122. The valve body 122 has a central axial through bore 150 and axial supply vent passages 152 and 154 on opposite sides of the bore 150. The bore 150 is counterbored at both axial ends 156 and 158 to receive rings 170 and 172 of the valve actuator 120 as detailed below. The supply passage 152 opens into the control chamber 100 at the front end 156 of the valve body 122 and is connected to the mating bore 132 in the helm piston 92 at the rear end 158. The vent passage 154 similarly opens into the control chamber 100 at the valve body front end 156 and opens into the vent passage 134 in the helm piston 92 at the valve body rear end 158. The supply valve 102 seats towards the front end of the supply passage 152. It includes a ball-valve element 160 and a return spring 162 that biases the ball-valve element 160 toward the front end 156 of the valve body 122. Conversely, the vent valve 108 seats towards the rear end of the vent passage 154. It includes a ball-valve element 164 and a return spring 166 that biases the ball-valve element 164 toward the rear end 158 of the valve body 122.

Still referring to FIGS. 5 and 6, the valve actuator 120 includes a nut 168 that is mounted on the threaded end of the steering shaft 68 and that is coaxially surrounded by the valve body 122. Hence, rotation of the shaft 68 in one direction or the other drives the valve actuator 120 to move linearly either towards or away from the rear end 80 of the helm cylinder 70. First and second rings 170 and 172 are mounted on opposite ends of the actuator 120 within the counterbored ends 156 and 158 of the valve body 122. The first ring 170 is press-fit against a notch on the front end of the valve actuator 120, or, alternatively, formed integrally with the valve actuator. The second ring 172 is clamped in a notch in the rear end by a nut 174 or otherwise affixed to the rear end. The rings 170 and 172 are spaced from one another by a distance L1 that is greater than the length L2 of the counterbored portion of the valve body 122, thereby forming a clearance at each end of the valve body 122 (having a maximum length of $((L1-L2)/2)$ that permits limited movement of the valve actuator 120 relative to the valve body 122 before one of the rings 170 or 172 contacts the associated counterbored end 156 or 158 in the valve body. Each ring 170, 172 has a tab 176, 178 that receives an actuator pin 180, 182 extending toward a respective passage 152, 154 in the valve body 122. Accordingly, when the valve actuator 120 moves relative to the valve body 122 in a first direction, the pin 180 engages the ball-valve element 160 to open the supply valve 102 (compare FIG. 5 to FIG. 7). Conversely, when the valve actuator 120 moves relative to the valve body 122 in a second direction, the pin 182 engages the ball-valve element 164 to open the vent valve 108 (compare FIG. 5 to FIG. 6). Both pins 180 and 182 are mounted on axially movable adjusters 184, 186 to permit selected setting of the valve clearance.

Figure 8:
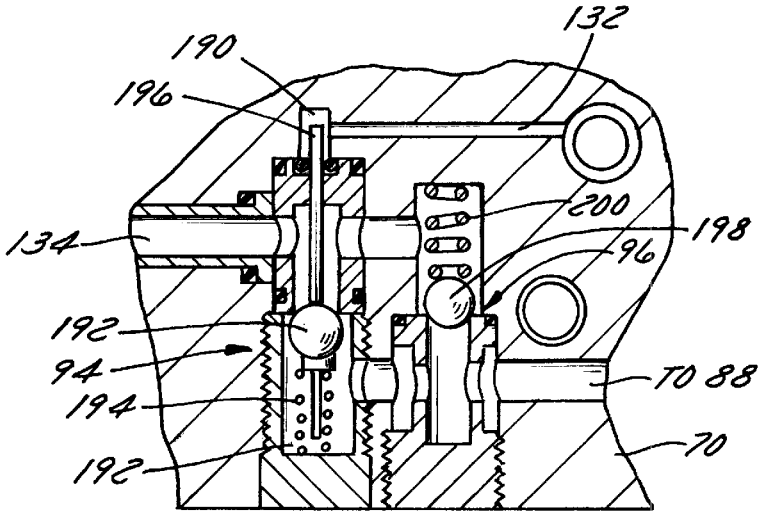
FIG. 8 is a side sectional elevation view of the detail "V" in FIGS. 5.

Referring to FIG. 8, the relief valve 94 is configured to permit continued manual steering of the system 10 in the event of failure of the pressure source 30. The relief valve 94 comprises a pilot valve mounted in a passage 190 that extends perpendicularly to the return passage 134 and that terminates in the supply passage 132. A ball 192, located in the passage 134, is biased towards its closed position by a spring 194. A plunger 196 is located on the other side of the ball 192 and extends into the supply passage 132. Fluid pressure in the supply passage 132 normally forces the plunger 196 downwardly to hold the valve 94 open and to permit unhindered fluid flow through to the outlet port 88 from the return passage 134. In the event of pump failure, the plunger 196 will no longer be forced downwardly by the supply pressure, at which point valve opening will be opposed by the return force of the spring 194. Flow through the return passage 134 will continue only for so long as the fluid pressure in the return passage 134 imposes an opening force on the ball 192 that exceeds the closing force imposed by the spring 194, thereby assuring at least minimal fluid pressure in the control chamber 100 and permitting manual steering of the system as detailed below.

Still referring to FIG. 8, the check valve 96 is located in parallel with the relief valve 94. Valve 96 permits fluid to be drawn into the return passage 134 from the reservoir 42 if the control chamber 100 requires make-up fluid. It comprises a conventional ball-valve element 198 biased to its closed position by a relatively weak return spring 200.

Figure 9:
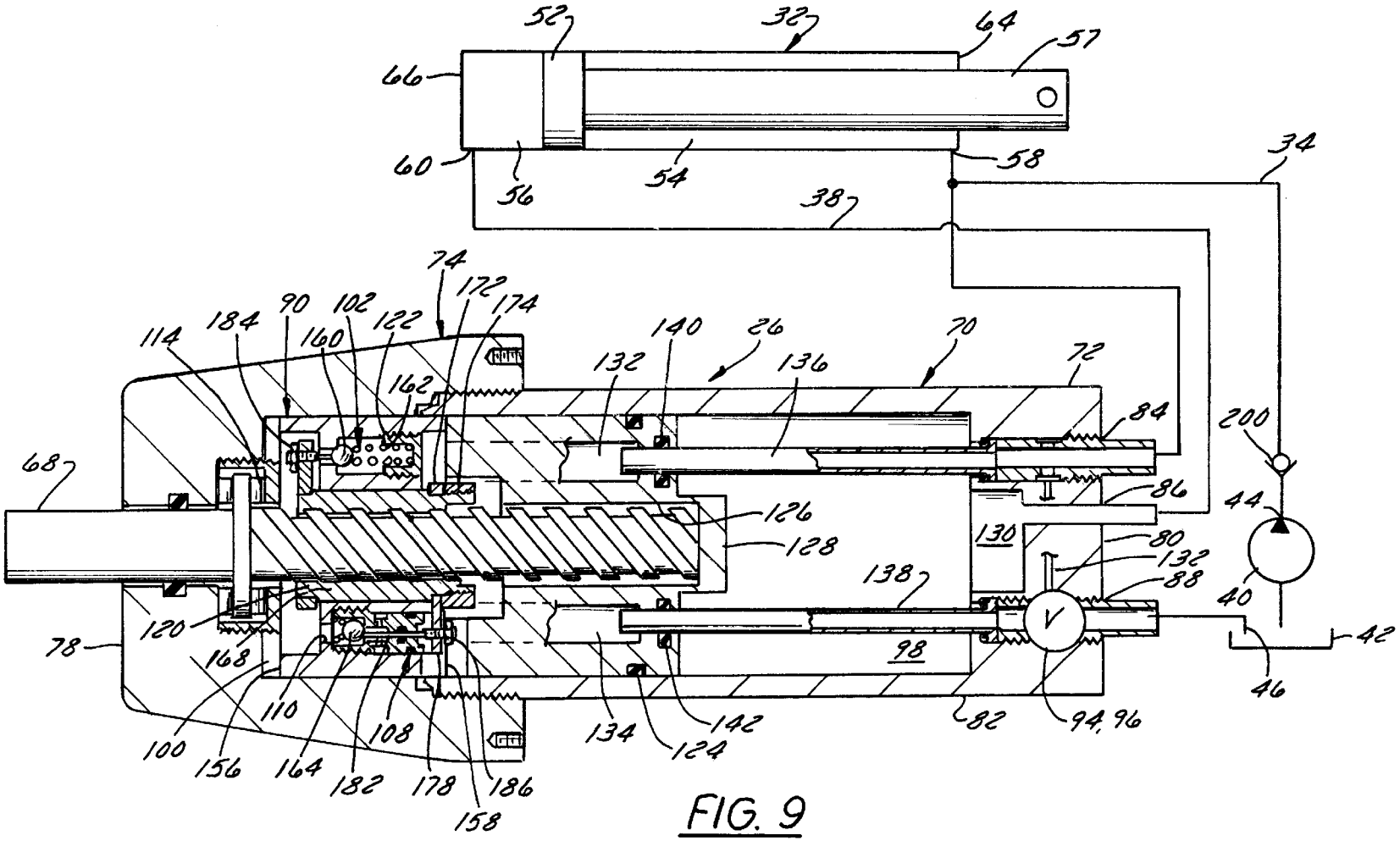
FIG. 9 corresponds to FIG. 5 and illustrates the system in a second operational state thereof.

The operation of the power assist steering system 10 will now be described, with the assumption that the components are in the positions illustrated in FIG. 5 and the steering wheel 28 and steering shaft 68 are stationary. The valve actuator 120 is balanced in the valve body 122 at this time, and both the supply and vent valves 102 and 108 are closed to block flow into or out of the control chamber 100. The pressures across both the helm piston 92 and the steering piston 52 are therefore balanced, and the helm piston 92 and steering piston 52 both remain stationary. Initial rotation of the steering shaft 68 in either direction drives the actuator 120 to move axially relative to the valve body 122 until one of the actuator pins opens the associated valve. Hence, clockwise shaft rotation drives the actuator 120 towards the front end 78 of the helm cylinder 70 and opens the vent valve 108 as illustrated in FIG. 6, thereby permitting pressurized fluid to flow out of the control chamber 100 through the vent valve 108 and the vent passage 134. Continued clockwise rotation of the shaft 68 will cause the actuator 120, valve body 122, and helm piston 92 to move axially as a unit within the helm cylinder 70 from the position illustrated in FIG. 5 toward the position illustrated in FIG. 9. This movement permits fluid to flow from the second chamber 56 of the steering cylinder 50 into the slave chamber 98 of the helm cylinder 70 via the slave conduit 38, to drive the steering piston 52 to the left as viewed in the drawings under the assistance of the pressure differential across the steering piston 52. When steering shaft rotation ceases, steering piston 52, the helm piston 92, and the valve body 122 continues to move to the left relative to the valve actuator 120, but only until the vent valve 108 closes and the valve body 122 rebalances on the valve actuator 120. The helm piston 92 and steering cylinder piston 52 will thereafter remain in those positions until the steering shaft 68 is once again rotated.

Counterclockwise rotation of the steering shaft 68 drives the valve actuator 120 to the right relative to the valve body 122 to open the supply valve 102 and couple the control chamber 100 to the supply passage 132. Subsequent movement of the helm piston 92 forces fluid into the second chamber 56 of the steering cylinder 50 from the slave chamber 98 and the slave conduit 38, thereby forcing the steering piston 52 to the right as seen in the drawings. This motion is assisted by the increasing fluid pressure in the control chamber 100. When shaft rotation ceases, the valve body 122 and helm piston 92 will continue to move to the right until the supply valve 102 closes and the valve body 122 rebalances on the valve actuator 120. The helm piston 92 and the steering cylinder piston 52 move at different rates. The rate is determined by the ratio of the area of the piston faces. It should again be noted that the total volumes of chambers 56 and 98 are equal and that the total stroke of the helm piston 92 results in the total stroke of the steering cylinder piston 52.

If the pump 40 fails, the system can be operated manually. Specifically, when the steering shaft 68 is turned counterclockwise, the actuator 120 unseats ball 160 and contacts the valve body 122. At this time the force exerted by operator input causes the actuator 120 to push the valve body 122 and helm piston 92 to the right. Fluid is forced out of the slave chamber 98 into chamber 56 of the steering cylinder 50, moving the steering cylinder piston 52 to the right. Fluid from chamber 54 of the steering cylinder 50 is forced out into the control chamber 100 past the unseated ball 160. Because the volume of the control chamber 100 is larger than the volume of the steering cylinder chamber 54, a negative pressure is created in control chamber 100. This negative pressure will lift check balls 198 and 201 from their seats, and fluid will be drawn from the reservoir 42 into control chamber 100. Check valve 200 prevents fluid from returning to the power source 30.

When the steering shaft 68 is turned clockwise, the valve actuator 120 unseats ball 190 and contacts the other side of the valve body 90. At this time the force exerted by operator input causes the actuator 120 to pull the valve body 122 and the helm piston 92 to the left. At this time, there is a decrease in pressure in chamber 56 of the steering cylinder 50 and the slave chamber 98 of the helm. There is also an increase in pressure in control chamber 100 of the helm. This increase in fluid pressure forces ball 160 off its seat, and fluid flows from control chamber 100 into chamber 54 of the steering cylinder 50. Because the volume of the control chamber 100 is larger than the volume of chamber 54 of the steering cylinder 50, the excess fluid in control chamber 100 must flow past ball 164, through passage 134 and past pressure relief valve 94, which is closed. The fluid pressure in control chamber 100 has to reach a predetermined level before the excess fluid can flow past the relief valve 94 back to the reservoir 42. This pressure is the backup pressure used to move the steering cylinder piston 52 to the left.

Many changes and modifications could be made to the invention without departing from the spirit thereof. Some of these changes are discussed above. Other changes will become apparent from the appended claims.

I claim:

1. A power steering assist system for a watercraft, comprising:

(A) a hydraulically actuated steering cylinder assembly that is configured for connection to a steered mechanism of the watercraft, said steering cylinder assembly including
  (1) a steering cylinder,
  (2) a steering piston that is mounted in said steering cylinder to define first and second chambers on opposite sides thereof, and
  (3) a rod that is affixed to said steering piston, wherein one of said rod and said steering cylinder is movable relative to the other and is configured for connection to the steered mechanism;

(B) a fluid pressure source that has an outlet fluidically coupled to said first chamber in said steering cylinder; and (C) an operator-controlled helm that is spaced from said steering cylinder assembly and that includes
  (1) a helm cylinder having a slave chamber fluidically coupled to said second chamber in said steering cylinder, a high pressure port fluidically coupled to said outlet of said pressure source and to said first chamber in said steering cylinder, and a return port fluidically coupled to vent,
  (2) a helm piston that is slidably mounted in said helm cylinder so as to form said slave chamber and a control chamber on opposite sides thereof, and
  (3) a control valve assembly that is movable between at least first and second positions to alternatively couple said control chamber to said high pressure and return ports.

2. The power steering assist system as recited in claim 1, wherein said control valve assembly is movable into a third, neutral position in which said control chamber is isolated from both of said high pressure and return ports.

3. The power steering assist system as recited in claim 2, wherein said helm further comprises an operator-manipulatable steering mechanism, and wherein said control valve assembly comprises first and second two-way/two-position valves that are configured to be actuated by said steering mechanism such that 1) both said first and second valves remain closed when the steering mechanism remains stationary, 2) movement of said steering mechanism in a first direction opens said first valve while leaving said second valve closed, and 3) movement of said steering mechanism in a second direction opens said second valve while leaving said first valve closed.

4. The power steering assist system as recited in claim 3, wherein said control valve assembly comprises a valve body that houses said first and second valves and a valve actuator that is linearly translatable between first, second, and third positions thereof, said valve body having a first passage formed therein that couples said high pressure port to said control chamber and a second passage formed therein that couples said return port to said control chamber, and wherein said first and second valves are located in said first and second passages, respectively.

5. The power steering assist system as recited in claim 4, wherein said valve actuator is coupled to a threaded shaft that rotates upon actuation of said steering mechanism to drive said valve actuator to translate linearly relative to said valve body.

6. The power steering assist system as recited in claim 1, further comprising a relief valve assembly that allows the system to be operated manually in the event of pressure source failure.

7. The power steering assist system as recited in claim 6, wherein said relief valve assembly includes a one-way/two-position pilot-operated valve that is responsive to pressure generated by said pressure source.

8. The power steering assist system as recited in claim 1, wherein said slave chamber in said helm cylinder has a slave port that is fluidically connected to said second chamber in said steering cylinder, and wherein said high pressure port, said return port, and said slave port are all located on a rear axial end of said helm cylinder.

9. The power steering assist system as recited in claim 1, wherein said helm cylinder has a diameter of no more than about 3".

10. The power steering assist system as recited in claim 1, wherein said steering cylinder of said steering cylinder assembly is stationary and said rod of said steering cylinder assembly is configured for connection to the steered mechanism.

11. A power steering assist system for a boat, comprising:

(A) a hydraulically actuated, unbalanced steering cylinder assembly that is configured for connection to a steered mechanism of the boat, said steering cylinder assembly including (1) a stationary steering cylinder that has a rod end and a cylinder end, (2) a steering piston that is slidably mounted in said steering cylinder to define first and second chambers on opposite sides thereof, wherein fluid pressures in said first and second chambers act on first and second different effective areas of said steering piston, and (3) a rod that is affixed to said steering piston, that extends axially through said rod end of said steering cylinder but not through said cylinder end, and that is configured for connection to the steered mechanism;

(B) a pump that has an inlet and an outlet fluidically coupled to said first chamber in said steering cylinder;

(C) a reservoir that is connected to said pump inlet; and (D) a helm that is spaced from said steering cylinder assembly and that is configured for coupling to a steering mechanism of the boat, said helm including (1) a steering shaft;

(2) a helm cylinder configured for mounting through a dash of the boat and having a slave port fluidically coupled to said second chamber of said steering cylinder, a high pressure port fluidically coupled to said pump outlet, and a return port fluidically coupled to said reservoir, (3) a helm piston that is slidably mounted in said helm cylinder so as to define a control chamber and a slave chamber on opposite sides of said helm piston, said helm piston having approximately equal effective surface areas on opposite sides thereof, said slave chamber being in fluid communication with said slave port in said helm cylinder, (4) a control valve assembly including a) a valve body that has a first passage that couples said high pressure port to said control chamber and a second passage that couples said return port to said control chamber, b) first and second two-way/two-position valves located in said first and second passages, c) a rotatable threaded shaft that rotates upon steering shaft rotation, and d) a valve actuator that is coupled to said threaded shaft so as to translate axially of said valve body upon threaded shaft rotation, said valve body cooperating with said first and second valves such that 1) both said first and second valves remain closed when the valve actuator is in a stationary position, 2) movement of said valve actuator in a first direction from the stationary position opens said first valve while leaving said second valve closed, and 3) movement of said valve actuator in a second position from the stationary position opens said second valve while leaving said first valve closed, and (5) a pilot actuated relief valve that allow manual operation of the system if said pressure source is inoperative but that otherwise permits unrestricted flow of fluid from said control chamber.

12. A helm assembly for a marine power steering assist system, said helm assembly comprising:

(A) a helm cylinder that is configured to extend through a dash of a watercraft, said helm cylinder having front and rear axial ends;

(B) a steering shaft that extends axially toward said front axial end of said helm cylinder from outside of said helm cylinder (C) a helm piston that is slidably mounted in said helm cylinder; and (D) a plurality of ports on said helm cylinder for fluidically coupling said helm cylinder to other hydraulic components of the power steering assist system so as to effect power steering of the system upon movement of said helm piston in said helm cylinder, all of said ports being formed on said rear axial end of said helm cylinder, said ports including a high pressure port configured to couple a chamber in said helm cylinder to a source of pressurized fluid.

13. The helm assembly as recited in claim 12, wherein said ports consist of said high pressure port, a return port configured to selectively vent said chamber in said helm cylinder, and a slave port configured to selectively permit pressurized fluid flow into and out of said slave port.

14. A method of steering a watercraft, comprising:

(A) transferring pressurized hydraulic fluid from a pressure source to a high pressure port of a helm cylinder and to a first chamber in an unbalanced hydraulic steering cylinder located remote from said helm cylinder, said first chamber being separated from a second chamber by a steering piston having unequal surface areas on opposite sides thereof and being coupled to a rod extending axially relative to said steering cylinder, a driven member formed by one of said steering cylinder and said rod and being coupled to a steered mechanism of the watercraft;

(B) in response to movement of a steering mechanism of the watercraft in a first direction from an at-rest position thereof, causing a helm piston in said helm cylinder to move in a first direction to force hydraulic fluid into a second chamber in said steering cylinder from a slave chamber in said helm cylinder, thereby causing said steered mechanism to move in a first direction; and (C) in response to movement of the steering mechanism in a second direction from the neutral position, causing said helm piston to move in a second direction to permit hydraulic fluid to flow into said slave chamber in said helm cylinder from said second chamber in said steering cylinder, thereby causing said steered member to move in a second direction opposite said first direction under a driving force imposed by pressurized fluid in said first chamber of said steering cylinder.

15. The method as recited in claim 14, wherein said helm piston is located in said helm cylinder so as to form said slave chamber on one side thereof and a control chamber on an opposite side thereof, when said steering mechanism is in the at-rest position, a control valve assembly of said helm is switched to a first state isolating said control chamber from said pressure source and from vent, when said steering mechanism moves in said first direction from said at-rest position, said control valve assembly switches to a second position fluidically coupling said control chamber to said pressure source, and wherein when said steering mechanism moves in said second direction, said valve assembly switches to a third position venting said control chamber.

16. The method as recited in claim 15, wherein rotation of the steering mechanism results in axial movement of a valve actuator of said control valve assembly between said first, second, and third positions thereof.

17. The method as recited in claim 15, further comprising restricting hydraulic fluid flow from said control chamber if said pressure source is inoperative.

18. A method of steering a watercraft, comprising:

(A) hydraulically driving a helm piston in a helm cylinder in response to operator-generated steering forces;

(B) in response to movement of said helm piston, driving a steering piston in a steering cylinder using pressurized fluid flowing into said steering cylinder from an external pressure source coupled to said helm cylinder; and (C) translating a steered mechanism of the watercraft using only driving forces generated by said steering piston.

19. The method of claim 18, wherein the driving steps comprise transferring pressurized hydraulic fluid from said pressure source to a high pressure port of said helm cylinder and to a first chamber in said steering cylinder, said first chamber being separated from a second chamber by said steering piston, said steering piston being coupled to a rod extending axially relative to said steering cylinder, a driven member formed by one of said steering cylinder and said rod being coupled to said steered mechanism of the watercraft.

* * * * *